US009187795B2

(12) United States Patent
Katsumata et al.

(10) Patent No.: US 9,187,795 B2
(45) Date of Patent: Nov. 17, 2015

(54) MIST COOLING APPARATUS, HEAT TREATMENT APPARATUS, AND MIST COOLING METHOD

(75) Inventors: Kazuhiko Katsumata, Saitama (JP); Ami Ueda, Tokyo (JP); Shinya Kudo, Tokyo (JP); Takahisa Shimada, Kagamihara (JP)

(73) Assignees: IHI CORPORATION (JP); IHI MACHINERY AND FURNACE CO., LTD. (JP)

( * ) Notice: Subject to any disclaimer, the term of this patent is extended or adjusted under 35 U.S.C. 154(b) by 234 days.

(21) Appl. No.: 13/514,191

(22) PCT Filed: Dec. 10, 2010

(86) PCT No.: PCT/JP2010/072251
§ 371 (c)(1),
(2), (4) Date: Jun. 6, 2012

(87) PCT Pub. No.: WO2011/071153
PCT Pub. Date: Jun. 16, 2011

(65) Prior Publication Data

US 2012/0242014 A1 Sep. 27, 2012

(30) Foreign Application Priority Data

Dec. 11, 2009 (JP) ..... P2009-281595

(51) Int. Cl.
*C21D 11/00* (2006.01)
*C21D 1/667* (2006.01)
*C21D 1/00* (2006.01)

(Continued)

(52) U.S. Cl.
CPC *C21D 1/667* (2013.01); *C21D 1/00* (2013.01); *C21D 1/62* (2013.01); *F27D 7/02* (2013.01); *F27D 15/02* (2013.01); *F27D 2009/0005* (2013.01); *F27D 2009/0072* (2013.01)

(58) Field of Classification Search
CPC ..... C21D 1/62; C21D 1/667
USPC ..... 266/114, 44, 113
See application file for complete search history.

(56) References Cited

U.S. PATENT DOCUMENTS 3,997,376 A * 12/1976 Hemsath et al. ..... 266/113
5,413,314 A * 5/1995 Plata et al. ..... 266/113

(Continued)

FOREIGN PATENT DOCUMENTS

CN 101386907 A 3/2009
JP 55-065318 5/1980

(Continued)

OTHER PUBLICATIONS

English Lang. Translation of JP2004245554A Sep. 2004.*

(Continued)

*Primary Examiner* — Scott Kastler
(74) *Attorney, Agent, or Firm* — Ostrolenk Faber LLP

(57) ABSTRACT

The invention adopts a mist cooling apparatus (3) that cools a heated treated subject M by spraying a cooling mist thereto, the mist cooling apparatus including: a first nozzle (35) that sprays a cooling mist; and a second nozzle (45) that sprays a cooling mist having a particle diameter smaller than the particle diameter of the cooling mist sprayed from the first nozzle.

4 Claims, 5 Drawing Sheets

(51) Int. Cl.

| | |
|---|---|
| ***C21D 1/62*** | (2006.01) |
| ***F27D 7/02*** | (2006.01) |
| ***F27D 15/02*** | (2006.01) |
| *F27D 9/00* | (2006.01) |

(56) References Cited

U.S. PATENT DOCUMENTS

| | | | | |
|---|---|---|---|---|
| 2010/0233062 | A1* | 9/2010 | Saiki et al. | 423/342 |
| 2012/0242014 | A1* | 9/2012 | Katsumata et al. | 266/44 |
| 2013/0032977 | A1* | 2/2013 | Katsumata et al. | 266/114 |

FOREIGN PATENT DOCUMENTS

| | | | |
|---|---|---|---|
| JP | 57-140861 | | 9/1982 |
| JP | 62-109613 | | 5/1987 |
| JP | 3-004604 | | 1/1991 |
| JP | 11-153386 | | 6/1999 |
| JP | 2001-262220 | | 9/2001 |
| JP | 2004245554 | A * | 9/2004 |
| JP | 2005-002398 | | 1/2005 |
| JP | 2005-126809 | | 5/2005 |
| WO | WO 2010/079452 | A1 | 7/2010 |

OTHER PUBLICATIONS

International Search Report and Written Opinion mailed Mar. 15, 2010 in corresponding PCT International Application No. PCT/JP2010/072251.

Chinese Office Action, dated Jan. 12, 2015, issued in corresponding Chinese Patent Application No. 201310720393.9. English translation of Search Report. Total 8 pages.

European Search Report, dated Jul. 27, 2015, issued in corresponding European Patent Application No. 10836072.8. Total 7 pages.

Koria Satish C., et al., "Studies On The Behaviour Of Mist Jet And Its Cooling Capacity Of Hot Steel Surface", *Steel Research*, Duesseldorf, DE, vol. 63, No. 1. (Jan. 1, 1992) pp. 19-26.

* cited by examiner

MIST COOLING APPARATUS, HEAT TREATMENT APPARATUS, AND MIST COOLING METHOD

CROSS-REFERENCE TO RELATED APPLICATIONS

The present application is a 35 U.S.C. §§371 national phase conversion of PCT/JP2010/072251, filed Dec. 10, 2010, which claims priority of Japanese Patent Application No. 2009-281595, filed Dec. 11, 2009, the contents of which are incorporated herein by reference. The PCT International Application was published in the Japanese language.

TECHNICAL FIELD

The present invention relates to a mist cooling apparatus, a heat treatment apparatus, and a mist cooling method.

BACKGROUND ART

Patent Document 1 discloses a mist cooling apparatus which is used for the heat treatment on a treated subject such as metal so as to cool the treated subject. The mist cooling apparatus sprays a mist-like cooling liquid to the heated treated subject so as to cool the treated subject using the latent heat of vaporization of the cooling liquid. For this reason, the mist cooling apparatus has high cooling performance compared to a gas ejecting type cooling apparatus of the related art. Further, when the mist ejection amount or the mist ejection time is adjusted, the mist cooling apparatus may easily control cooling speed of the treated subject which is difficult to control in an immersion type cooling apparatus of the related art.

CITATION LIST

Patent Document

[Patent Document 1] Japanese Unexamined Patent Application, First Publication No. H11-153386

SUMMARY OF INVENTION

Problems to be Solved by the Invention

However, the above-described related art has the following problems.

In the heat treatment of the treated subject, the treated subject may be cooled by a predetermined cooling pattern in order to transform the structure of the treated subject into a predetermined structure. For example, rapid cooling is performed during a certain period in accordance with the type of the treated subject. On the other hand, gentle cooling is performed during the other period while the uniformity of cooling is maintained so as to prevent deformation or warpage and the like, of the treated subject. In the related art, the cooling on different cooling speeds is performed by adjusting the mist ejection amount and the mist ejection time. However, it is difficult to cool the treated subject at a wide range of cooling speeds through the adjustment of the mist ejection amount and the mist ejection time. Further, there is a possibility that the necessary cooling speed may not be ensured in accordance with the type of the treated subject.

The invention is made in view of the above-described circumstances, and it is an object of the invention to provide a mist cooling apparatus, a heat treatment apparatus, and a mist cooling method capable of cooling a treated subject at a wide range of cooling speeds.

Means for Solving the Problem

In order to solve the above-described problem, the invention adopts the following means.

According to the invention, there is provided a mist cooling apparatus that cools a heated treated subject by spraying a cooling mist thereto, the mist cooling apparatus including: a first nozzle that sprays a cooling mist; and a second nozzle that sprays a cooling mist having a particle diameter smaller than the particle diameter of the cooling mist sprayed from the first nozzle.

In the invention, the particle diameter of the cooling mist which is sprayed from the first nozzle is larger than the particle diameter of the cooling mist which is sprayed from the second nozzle. For this reason, the amount of latent heat of vaporization for each particle of the cooling mist of the first nozzle is larger than that of the cooling mist of the second nozzle. For this reason, in the cooling using the first nozzle, the treated subject may be rapidly cooled compared to the case of using the second nozzle. On the other hand, in the cooling using the second nozzle, the treated subject may be gently cooled while the uniformity of cooling is maintained compared to the case of using the first nozzle.

Further, in the invention, the first nozzle and the second nozzle diffuse and spray the cooling mists. Then, the diffusion angle of the cooling mist in the first nozzle is narrower than the diffusion angle of the cooling mist in the second nozzle.

Further, the mist cooling apparatus of the invention further includes a control unit that controls each spraying amount of the first nozzle and the second nozzle in accordance with a cooling pattern of the subject treatment material.

Further, in the invention, the control unit switches the spraying of the cooling mist between the first nozzle and the second nozzle in accordance with the cooling pattern of the treated subject.

Further, according to the invention, there is provided a heat treatment apparatus that performs a heat treatment on a treated subject, the heat treatment apparatus including: the mist cooling apparatus.

Further, according to the invention, there is provided a mist cooling method of cooling a heated treated subject by spraying a cooling mist thereto, the mist cooling method including: cooling the treated subject by using a first nozzle spraying a cooling mist and a second nozzle spraying a cooling mist having a particle diameter smaller than the particle diameter of the cooling mist sprayed from the first nozzle.

In the invention, the particle diameter of the cooling mist which is sprayed from the first nozzle is larger than the particle diameter of the cooling mist which is sprayed from the second nozzle. For this reason, the amount of latent heat of vaporization for each particle of the cooling mist of the first nozzle is larger than that of the cooling mist of the second nozzle. For this reason, in the cooling using the first nozzle, the treated subject may be rapidly cooled compared to the case of using the second nozzle. On the other hand, in the cooling using the second nozzle, the treated subject may be gently cooled while the uniformity of cooling is maintained compared to the case of using the first nozzle.

Effects of the Invention

According to the invention, it is possible to obtain the following effects.

The invention includes the first nozzle which is used for the rapid cooling and the second nozzle which is used for the gentle cooling with maintaining the uniformity of cooling. For this reason, it is possible to cool the treated subject of the heat treatment at a wide range of cooling speeds. Further, the rapid cooling is performed during a certain period and the gentle cooling may be performed with the uniformity of cooling during the other period so as to prevent deformation or warpage of the treated subject.

DESCRIPTION OF EMBODIMENTS

Figure 1:
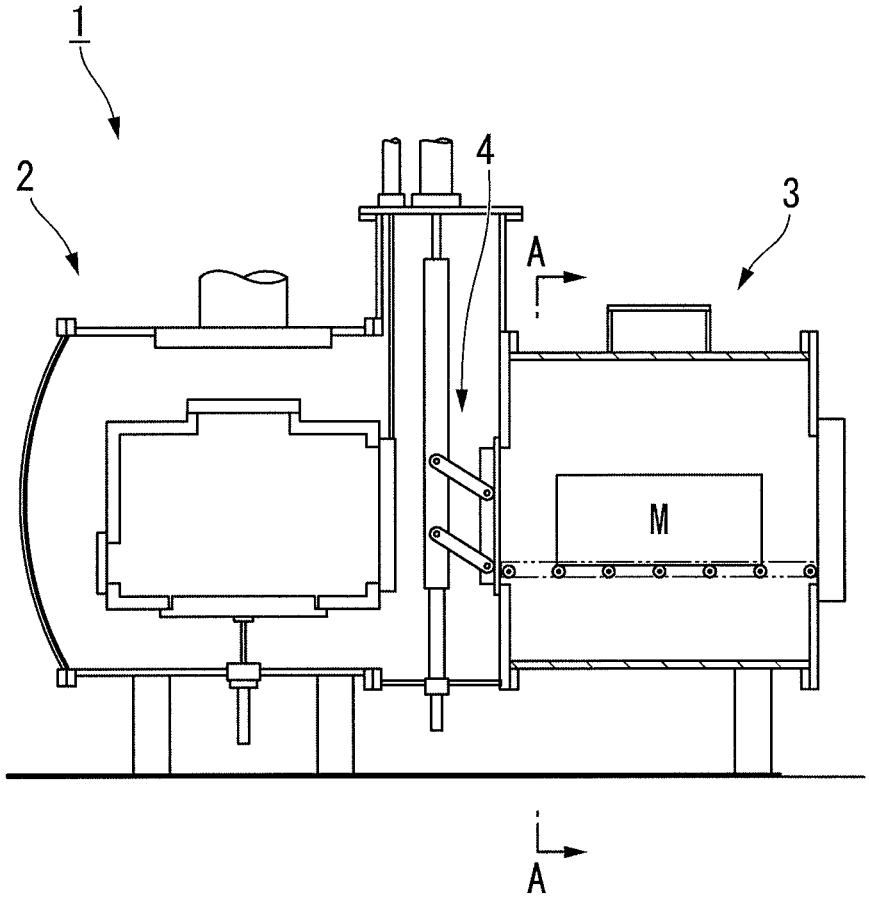
FIG. 1 is an overall configuration diagram illustrating a heat treatment apparatus 1.

Hereinafter, an embodiment of the invention will be described by referring to FIGS. 1 to 5C. Furthermore, in the drawings used in the following description, the scales of the members are appropriately changed so that the respective members are changed into recognizable sizes. Further, in the following description, a two-chamber-type heat treatment apparatus will be exemplified as a heat treatment apparatus.

FIG. 1 is an overall configuration diagram illustrating a heat treatment apparatus 1 according to the present embodiment.

The heat treatment apparatus 1 is an apparatus which performs a heat treatment such as quenching on a treated subject M. The heat treatment apparatus 1 includes a heating chamber 2 and a cooling chamber (mist cooling apparatus) 3. The heating chamber 2 and the cooling chamber 3 are disposed so as to be adjacent to each other. A partition wall 4 which is openable and closable is provided between the heating chamber 2 and the cooling chamber 3. A carriage path is formed so as to carry the treated subject M from the heating chamber 2 toward the cooling chamber 3 when the partition wall 4 is opened. Further, the heating chamber 2 and the cooling chamber 3 are respectively sealed when the partition wall 4 is closed.

The treated subject M is subjected to the heat treatment by the heat treatment apparatus 1, and is formed of a metal material such as steel (which includes an alloy) containing a predetermined amount of carbon. The structure of the treated subject M is transformed into a desired predetermined structure by the heat treatment. Further, the treated subject M is cooled by a predetermined cooling pattern (for example, a pattern with a rapid cooling period and a gentle cooling period) so that the treated subject is not transformed into a structure other than the desired structure and is uniformly transformed into a desired structure. In the respective drawings used in the following description, the treated subject M is depicted as a rectangular parallelepiped shape, but the shape and the size of the material, the number of treated materials at a batch, and the like may vary. An example of the treated subject M may include steel such as dies steel (SKD steel) or high-speed steel (SKH steel). In the present embodiment, a case will be described in which dies steel (SKD61) is exemplified as the treated subject M.

Next, the configuration of the cooling chamber 3 will be described by referring to FIGS. 2 to 3B.

Figure 2:
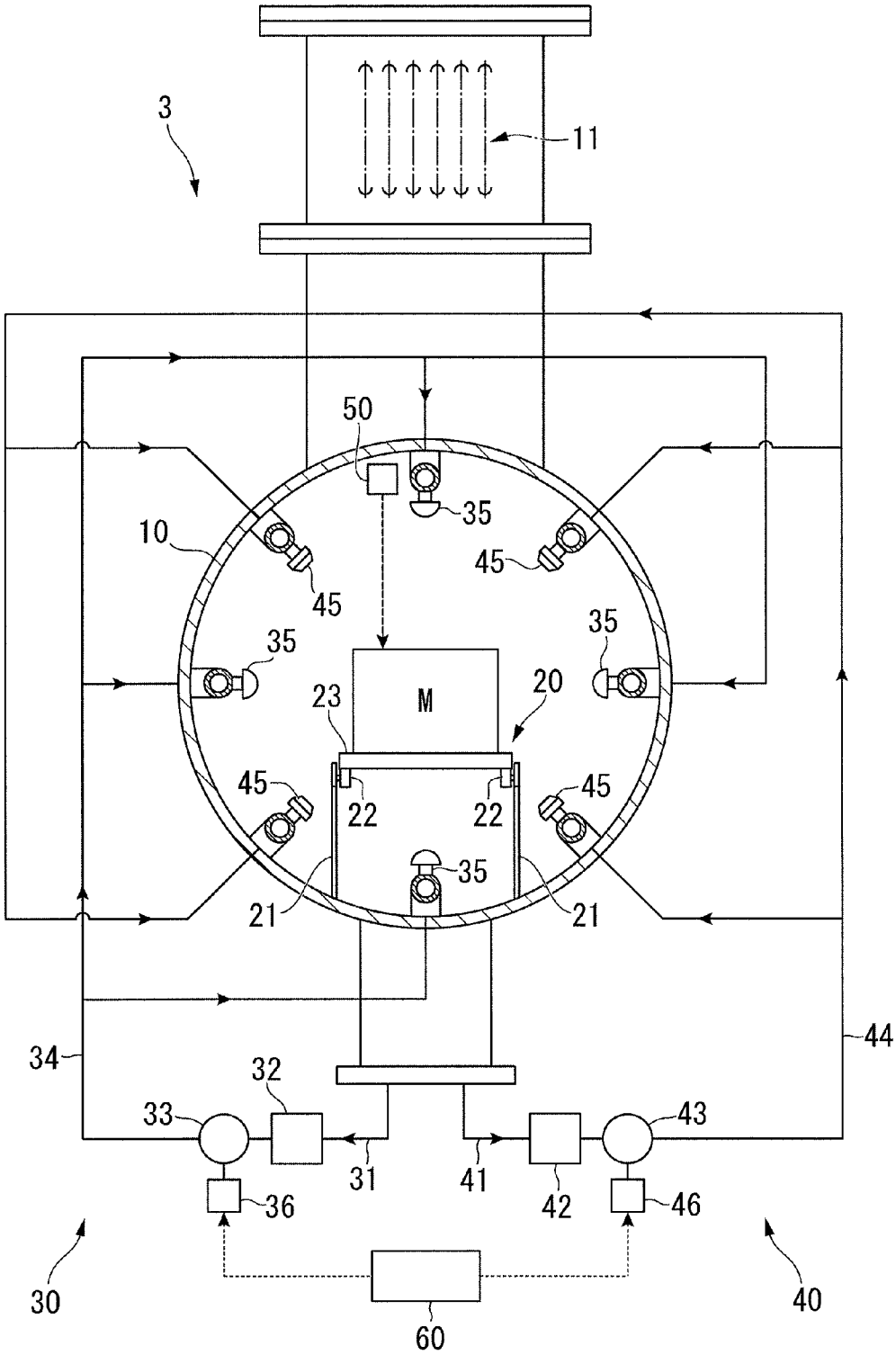
FIG. 2 is a schematic diagram illustrating a configuration of a cooling chamber 3.
Figure 3A:
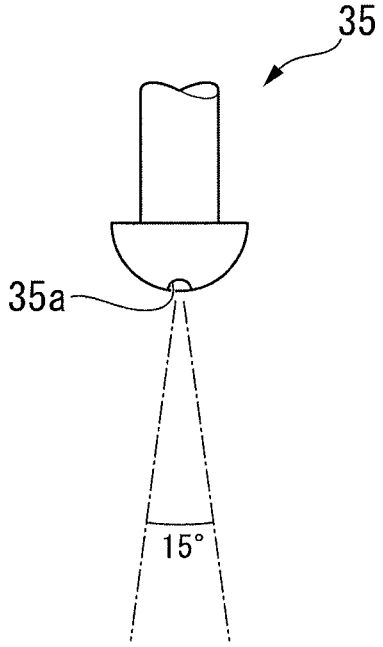
FIG. 3A is a schematic diagram illustrating a first nozzle 35.

FIG. 2 is a schematic diagram illustrating the configuration of the cooling chamber 3 according to the present embodiment. Furthermore, FIG. 2 is a cross-sectional view taken along the line A-A of FIG. 1. FIG. 3A is a side view illustrating a first nozzle 35 which is installed in the cooling chamber 3. Further, FIG. 3B is a side view illustrating a second nozzle 45.

As shown in FIG. 2, the cooling chamber 3 includes a container 10, a carriage unit 20, a first cooling system 30, a second cooling system 40, a temperature measuring unit 50, and a control unit 60.

The container 10 is a substantially cylindrical container which forms the outer shell of the cooling chamber 3 and forms a hermetic space therein. A liquefier (liquefying trap) 11 which liquefies a cooling liquid evaporated again by the heat transmitted from the treated subject M is installed at the upper portion of the container 10.

The carriage unit 20 is a member which carries the treated subject M from the heating chamber 2 into the cooling chamber 3 and further carries the treated subject to the outside from the cooling chamber 3. Then, the carriage unit 20 is a member which carries the treated subject M in the direction parallel to the axis of the container 10. The carriage unit 20 includes a pair of support frames 21, a plurality of carriage rollers 22, and a roller driving unit (not shown).

The pair of support frames 21 are uprightly formed in the bottom portion inside the container 10, and support the treated subject M from below through the plurality of carriage rollers 22. The pair of support frames 21 are formed so as to extend in the direction in which the treated subject M is carried. The plurality of carriage rollers 22 are provided in the facing surfaces of the pair of support frames 21 so as to be rotatable with a predetermined gap in the carriage direction. The treated subject M is smoothly carried with the rotation of the plurality of carriage rollers 22. A roller driving unit (not shown) is a member which rotates the carriage roller 22. Further, the treated subject M of the present embodiment is not directly placed on the carriage roller 22, but is placed on the carriage roller 22 with a tray 23. As the tray 23, for example, a mesh-like tray or a tray in which a plurality of hole portions (punched holes and the like) are formed in a plate material is used so that a cooling mist passes therethrough.

In the first cooling system 30, a mist-like cooling liquid is sprayed toward the treated subject M provided inside the heated container 10, so that the treated subject M is cooled. Further, the first cooling system 30 is used when the treated subject M is rapidly cooled. The first cooling system 30 includes a first recovery pipe 31, a first heat exchanger 32, a first pump 33, a first supply pipe 34, and a plurality of first nozzles 35. Furthermore, as the cooling liquid, for example, water, oil, salt, or a fluorinated inactive liquid is used.

The first recovery pipe 31 is a tubular member which collects the cooling liquid supplied into the container 10 and the cooling liquid that evaporates by the heat transmitted from the subject treatment material M and is liquefied again by the liquefier 11. Furthermore, the cooling liquid which is collected by the first recovery pipe 31 is heated by the heat transmitted from the subject treatment material M. The first heat exchanger 32 is a heat exchanger which cools the collected cooling liquid.

The first pump 33 is a member that discharges the cooling liquid, which is collected from the inside of the container 10 and is introduced into the first recovery pipe 31, to the first supply pipe 34 so that the cooling liquid flows toward the first nozzle 35. A first inverter 36 is connected to the first pump 33. The first inverter 36 is a member which drives the first pump 33 in accordance with a command of a control unit 60 to be described later. Furthermore, a plurality of the first pumps 33 may be disposed in parallel with respect to the first supply pipe 34. When the plurality of first pumps 33 are disposed in parallel, a large flow volume which cannot be produced by one pump may be produced. For this reason, it is possible to broadly set a range where the flow volume of the cooling liquid is adjusted in the first cooling system 30.

The first supply pipe 34 is a tubular member which supplies the cooling liquid discharged from the first pump 33 to the plurality of first nozzles 35 to be described later. Furthermore, the first supply pipe 34 may be equipped with a valve (not shown) which interrupts the supply of the cooling liquid to the first nozzle 35.

The first nozzle 35 is a member which cools the treated subject M by spraying the mist-like cooling liquid (the cooling mist) to the subject treatment material M which is heated and is provided inside the heated container 10. Further, the first nozzle 35 is used when the treated subject M is rapidly cooled. A plurality of the first nozzles 35 may be provided in the inner wall of the container 10 so as to surround the treated subject M and may be disposed in the axial direction of the container 10. As a result, the portion which does not contact the mist in the treated subject M decreases as much as possible. Then, since the treated subject M is uniformly cooled, it is possible to prevent deformation or the like of the treated subject M due to the non-uniformity of cooling.

As shown in FIG. 3A, the first nozzle 35 is a member which includes one spraying port 35*a* and diffuses and sprays the cooling mist from the spraying port 35*a*. The particle diameter of the cooling mist which is sprayed from the first nozzle 35 is set to be larger than the particle diameter of the cooling mist which is sprayed from the second nozzle 45 to be described later. Since the particle diameter of the cooling mist which is sprayed from the first nozzle 35 is large, the amount of vaporization latent heat of the mist for each particle increases.

Further, the diffusion angle of the cooling mist which is diffused and sprayed from the first nozzle 35 is set to be about 15°. The diffusion angle of the cooling mist in the first nozzle 35 is set to be narrower than the diffusion angle of the cooling mist in the second nozzle 45. The first nozzle 35 is installed in the inner wall of the container 10 so that the direction of the spraying port 35*a* faces the treated subject M which is installed inside the container 10.

As shown in FIG. 2, in the second cooling system 40, the mist-like cooling liquid is sprayed to the treated subject M which is provided inside the heated container 10, so that the treated subject M is cooled. Further, the second cooling system 40 is used when the treated subject M is gently cooled while the uniformity of cooling is maintained. The second cooling system 40 includes a second recovery pipe 41, a second heat exchanger 42, a second pump 43, a second supply pipe 44, and a plurality of second nozzles 45. Furthermore, as the cooling liquid, for example, water, oil, salt, or a fluorinated inactive liquid is used. Since the configuration of the second cooling system 40 except for the second nozzle 45 is the same as that of the first cooling system 30, the description thereof will be omitted and hereinafter, the second nozzle 45 will be described.

The second nozzle 45 is a member which sprays the mist-like cooling liquid (the cooling mist) to the treated subject M which is heated and is provided inside the heated container 10, and cools the treated subject M. Further, the second nozzle 45 is a member which is used when the treated subject M is gently cooled while the uniformity of cooling thereof is maintained. A plurality of the second nozzles 45 are provided in the inner wall of the container 10 so as to surround the treated subject M and are disposed in the axial direction of the container 10. As a result, the portion in the subject treatment material M in which the mist does not contact decreases as much as possible. For this reason, the subject treatment material M is uniformly cooled, so that it is possible to prevent deformation or the like of the treated subject M due to the non-uniformity of cooling.

Figure 3B:
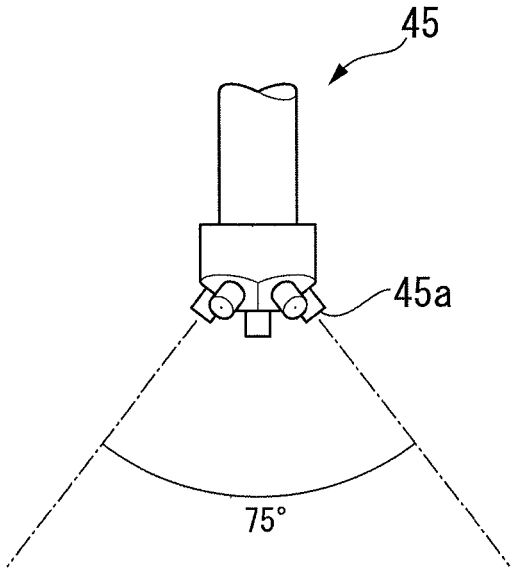
FIG. 3B is a schematic diagram illustrating a second nozzle 45.

As shown in FIG. 3B, the second nozzle 45 is a member which includes a plurality of (in the present embodiment, seven) spraying ports 45*a* and diffuses and sprays the cooling mist from the plurality of spraying ports 45*a*. One of the plurality of spraying ports 45*a* is disposed at the center portion of the distal end of the second nozzle 45, and the other spraying ports 45*a* are arranged around the center portion of the distal end. The particle diameter of the cooling mist which is sprayed from the second nozzle 45 is set to be smaller than the particle diameter of the cooling mist which is sprayed from the first nozzle 35. Since the particle diameter of the cooling mist which is sprayed from the second nozzle 45 is small, the amount of vaporization latent heat of the mist for each particle decreases. Further, since the particle diameter of the cooling mist which is sprayed from the second nozzle 45 is small, the time for which the cooling mist sprayed from the second nozzle 45 stays inside the container 10 becomes longer than the time for which the cooling mist sprayed from the first nozzle 35 stays therein. In addition, since the particle diameter of the cooling mist is small, the cooling mist which is sprayed from the second nozzle 45 may irregularly flow to the space inside the container 10 compared to the cooling mist which is sprayed from the first nozzle 35.

Further, the diffusion angle of the cooling mist which is diffused and sprayed from the second nozzle 45 is set to be about 75°. The diffusion angle of the cooling mist in the second nozzle 45 is set to be wider than the diffusion angle of the cooling mist in the first nozzle 35. The second nozzle 45 is installed in the inner wall of the container 10 so that the direction of the spraying port 45*a* positioned at the center among the plurality of spraying ports 45*a* faces the treated subject M provided inside the container 10.

The temperature measuring unit 50 is a measurement unit which is provided inside the container 10 and measures the surface temperature of the treated subject M which is being cooled in a non-contact manner. The temperature measuring unit 50 is electrically connected to the control unit 60 (the connection is not shown), and outputs the temperature measurement value to the control unit 60.

The control unit 60 is a member which controls the driving of the first pump 33 through the first inverter 36 and controls the driving of the second pump 43 through the second inverter 46 in accordance with the cooling pattern of the treated subject M based on the temperature of the treated subject M measured by the temperature measuring unit 50. The control unit 60 may individually control the driving of the first pump 33 and the driving of the second pump 43. Further, the control unit 60 may drive only one of the first pump 33 and the second pump 43.

Further, the control unit 60 includes a memory which is used to store data therein. Then, the memory in the control unit 60 stores the correlation between the supply amount per unit hour of the cooling mist and the surface temperature and the inner temperature of the treated subject M as table data. The control unit 60 is configured to measure the inner temperature of the subject treatment material M from the measurement result (the surface temperature of the subject treatment material M) of the temperature measuring unit 50 using the table data. Furthermore, the table data of the correlation is created by, for example, a preliminary experiment, a simulation, or the like.

Subsequently, the procedure (cooling process) in which the heated treated subject M is cooled by the cooling chamber 3 in the heat treatment apparatus 1 according to the present embodiment will be described by referring to FIGS. 4 to 5C. Furthermore, in the following description, the quenching which transforms the structure of the treated subject treatment material M maintained at the quenching temperature into a martensitic structure will be described.

Figure 4:
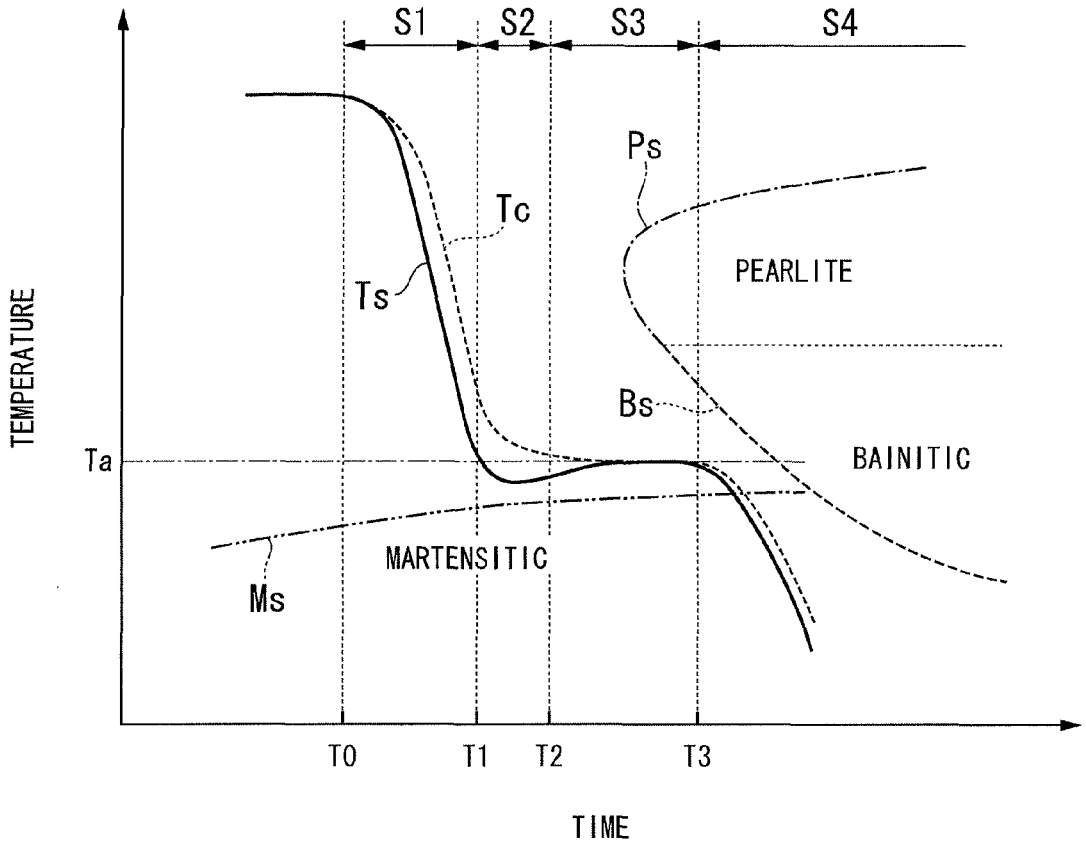
FIG. 4 is a graph illustrating a heat treatment method to be performed on a subject treatment material M.

FIG. 4 is a graph illustrating a heat treatment method to be performed on the treated subject M. In FIG. 4, the vertical axis indicates the temperature and the horizontal axis indicates the time. Further, in FIG. 4, the solid line Ts indicates a change in the temperature of the surface of the treated subject M, and the dashed line Tc indicates a change in the temperature of the inside of the treated subject M.

Figure 5A:
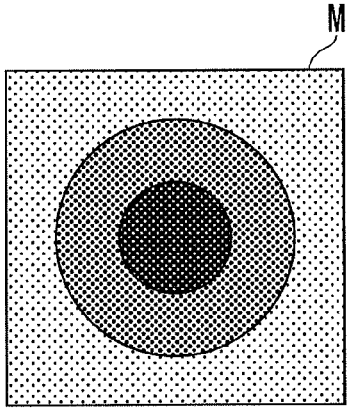
FIG. 5A is a cross-sectional view illustrating a temperature distribution of the treated subject M at the time T1.
Figure 5B:
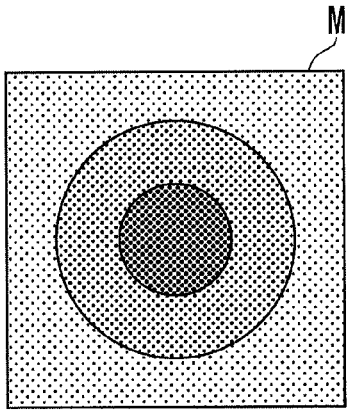
FIG. 5B is a cross-sectional view illustrating a temperature distribution of the treated subject M at the time T2.
Figure 5C:
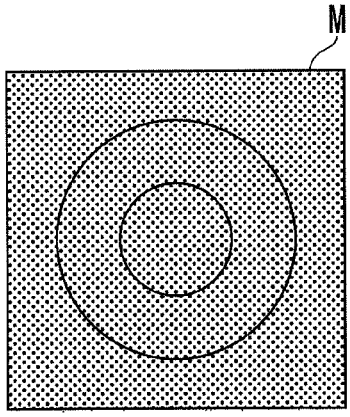
FIG. 5C is a cross-sectional view illustrating a temperature distribution of the treated subject M at the time T3.

FIGS. 5A to 5C are cross-sectional views illustrating a change in the temperature between the surface and the inside of the treated subject M. FIGS. 5A to 5C illustrate the temperature distribution state of the treated subject M which sequentially change with the passage of time of FIG. 4. FIG. 5A illustrates the temperature distribution at the time T1. FIG. 5B illustrates the temperature distribution at the time T2. FIG. 5C illustrates the temperature distribution at the time T3. Furthermore, in FIGS. 5A to 5C, the high temperature and the low temperature in the temperature are depicted as the contrasting density of the halftone dot.

As shown in FIG. 4, in the heat treatment method of the present embodiment, first, the treated subject M which is heated to the state of the austenitic structure (about 1000° C.) is cooled using the first cooling system 30 from the time T0 so as to reach the target temperature Ta which is higher than the transformation point Ms in the vicinity of the transformation point Ms where the structure starts to be transformed into the martensitic structure (a first rapid cooling process S1).

The target temperature Ta is set so as to be lower than the transformation point Ps where the structure of the treated subject M starts to be transformed into the pearlite structure, and is set so as to be higher than the transformation point Ms where the structure of the treated subject M starts to be transformed into the martensitic structure. In the present embodiment, since the treated subject M is the dies steel (SKD61), the target temperature Ta is set from 370° C. to 550° C. Furthermore, it is desirable that the target temperature Ta is set to the temperature near the transformation point Ms (the temperature which is higher than the transformation point Ms by several tens of ° C.) in consideration of the treatment in a second rapid cooling process S4 to be described later.

In the first rapid cooling process S1, the treated subject M is rapidly cooled to the target temperature Ta by the mist cooling so as to avoid the transformation point Ps (so-called pearlite nose) where the structure starts to be transformed into the pearlite structure. In the present embodiment, the mist-like cooling liquid is supplied and sprayed from the first nozzle 35 of the first cooling system 30 to the subject treatment material M which is carried to the cooling chamber 3.

The control unit 60 drives the first pump 33 through the first inverter 36. At this time, the second pump 43 of the second cooling system 40 is stopped. By the driving of the first pump 33, the cooling liquid which is collected from the container 10 and is introduced into the first recovery pipe 31 is cooled by the first heat exchanger 32, and is sent to the first supply pipe 34. The cooling liquid which flows inside the first supply pipe 34 is sprayed in a mist shape from the plurality of first nozzles 35. Since the spraying port 35*a* of the first nozzle 35 is provided so as to face the treated subject M, the cooling mist which is sprayed from the first nozzle 35 adheres to the treated subject M. When the adhering cooling mist vaporizes by taking the vaporization latent heat from the treated subject M, the treated subject M is cooled.

The particle diameter of the cooling mist which is sprayed from the first nozzle 35 is set to be larger than the particle diameter of the cooling mist which is sprayed from the second nozzle 45, and the amount of vaporization latent heat of the mist for each particle of the first nozzle is larger than that of the second nozzle. For this reason, the particle diameter of the cooling mist which is sprayed from the first nozzle 35 may take much vaporization latent heat from the treated subject M. For this reason, the treated subject M is rapidly cooled.

Further, the diffusion angle of the cooling mist which is diffused and sprayed from the first nozzle 35 is set to be about 15°. Further, the diffusion angle of the cooling mist in the first nozzle 35 is set to be narrower than the diffusion angle of the cooling mist in the second nozzle 45. For this reason, the cooling mist which is sprayed from the first nozzle 35 may effectively contact the treated subject M. For this reason, the treated subject M is rapidly cooled.

Here, as the basic cooling of the mist cooling, the surface of the treated subject is cooled by the vaporization latent heat. For this reason, a difference in the temperature between the surface and the inside of the treated subject M occurs according to a degree in which the cooling mist contacts the treated subject (see FIG. 5A). For example, as depicted by the solid line Ts and the dashed line Tc shown in FIG. 4, the temperature of the surface of the treated subject M decreases in a short time compared to the temperature of the inside of the treated subject M. For this reason, a difference in the temperature between the temperature of the surface of the treated subject M and the temperature of the inside of the treated subject M increases with the passage of time.

Next, in the heat treatment method of the present embodiment, when the measurement temperature of the temperature measuring unit 50 provided inside the container 10 (that is, the surface temperature of the treated subject M) decreases so as to be lower than the target temperature Ta, the treated subject M is cooled by the second cooling system 40 (the gentle cooling process S2).

In the gentle cooling process S2, the treated subject M is cooled with a cooling efficiency lower than that of the first rapid cooling process S1 using the second cooling system 40. At this time, since the heat is transmitted from the inside with a high temperature to the surface with a low temperature in the treated subject M, a difference in the temperature between the surface and the inside of the treated subject decreases.

The control unit 60 stops the driving of the first pump 33, and drives the second pump 43 through the second inverter 46. That is, the pump which is being driven is switched from the first pump 33 to the second pump 43 (an adjusting process). By the driving of the second pump 43, the cooling liquid which is collected from the container 10 and is introduced into the second recovery pipe 41 is cooled by the second heat exchanger 42, and is sent to the second supply pipe 44. The cooling liquid which flows inside the second supply pipe 44 is sprayed in a mist shape from the plurality of second nozzles 45. The second nozzles 45 are provided so as to face the treated subject M. For this reason, the cooling mist which is sprayed from the second nozzle 45 adheres to the subject treatment material M. When the adhering cooling mist vaporizes by taking the vaporization latent heat from the treated subject M, the treated subject M is cooled.

The particle diameter of the cooling mist which is sprayed from the second nozzle 45 is set to be smaller than the particle diameter of the cooling mist which is sprayed from the first nozzle 35, and the amount of vaporization latent heat of the mist for each particle of the second nozzle is smaller than that of the first nozzle. For this reason, the amount of vaporization latent heat which is taken from the treated subject M decreases, so that the treated subject M may be gently cooled. The amount of heat which is taken from the surface of the treated subject M decreases, and the heat is transmitted from the inside with a high temperature to the surface with a low temperature by the thermal conduction, so that a difference in the temperature between the surface and the inside of the treated subject decreases. That is, the treated subject M is cooled while the temperature becomes uniform.

Further, the diffusion angle of the cooling mist diffused and sprayed from the second nozzle 45 is set to be about 75°. Further, the diffusion angle of the cooling mist in the second nozzle 45 is set to be wider than that of the diffusion angle of the cooling mist in the first nozzle 35. In addition, since the particle diameter of the cooling mist is small, the cooling mist which is sprayed from the second nozzle 45 may stay in the space inside the container 10 and irregularly flow in the space inside the container 10 for a long time compared to the cooling mist which is sprayed from the first nozzle 35. Accordingly, the cooling mist which is sprayed from the second nozzle 45 may adhere to a position where the cooling mist hardly adheres depending on, for example, the size, the shape, and the like of the treated subject M. That is, the treated subject M is cooled while the temperature becomes uniform.

In the gentle cooling process S2, the temperature of the entire treated subject M increases so as to be higher than the target temperature Ta by the thermal conduction from the inside with a high temperature, so that cooling is performed so as not to reach the transformation point of other structures which is not desired (for example, the transformation point Ps). That is, in the gentle cooling process S2, cooling is performed so as to cancel an increase in the temperature by the thermal conduction from the inside with a high temperature. Further, in the gentle cooling process S2, the cooling efficiency (the amount of the cooling mist which is sprayed from the second nozzle 45) is adjusted by the control unit 60 so that the surface temperature of the treated subject M does not reach the transformation point Ms by the cooling.

The gentle cooling process S2 is performed until the temperature of the inside of the treated subject M is almost equal to the target temperature Ta. Accordingly, it is possible to prevent the temperature of the entire treated subject M from increasing so as to be higher than the target temperature Ta. Furthermore, the temperature of the inside of the treated subject M of the present embodiment is measured by referring to the measurement result of the temperature measuring unit 50 provided inside the container 10 and the table data stored in the memory of the control unit 60. In the treated subject M subjected to the gentle cooling process S2, as shown in FIG. 5B, the temperature distribution between the surface and the inside becomes gentler than that of FIG. 5A.

Next, in the heat treatment method of the present embodiment, the supply of the cooling mist is stopped, and the treated subject M is held for a predetermined time (the holding process S3).

In the holding process S3, the treated subject M is held for a predetermined time while the supply of the cooling mist is stopped, so that the heat is transmitted from the inside of the treated subject M to the surface thereof by the thermal conduction, and a difference in the temperature between the surface and the inside of the treated subject M further decreases. The mist cooling stop period of the holding process S3 continues until a difference in the temperature between the surface and the inside of the subject treatment material M becomes a value less than a predetermined threshold value (for example, 10° C.). In the present embodiment, the mist cooling stop period of the holding process S3 is ended when a difference in the temperature between the surface and the inside of the treated subject M becomes a value less than a predetermined threshold value through the monitoring the temperatures of the surface and the inside of the treated subject M using the table data of the control unit 60 and the temperature measuring unit 50.

Furthermore, the mist cooling stop period of the holding process S3 may be ended as below. The time in which a difference in the temperature between the surface and the inside of the treated subject M becomes a value less than a predetermined threshold value is estimated from a thermal conduction rate and a difference in the temperature between the surface and the inside of the treated subject M when the gentle cooling process S2 is ended, and the mist cooling stop period is ended when the time has elapsed. In the treated subject M which is subjected to the holding process S3, as shown in FIG. 5C, the temperatures of the surface and the inside of the treated subject M become uniform so as to be equal to the target temperature Ta.

Finally, in the heat treatment method of the present embodiment, the subject treatment material M is cooled to a temperature which is less than or equal to the transformation point Ms (the second rapid cooling process S4).

In the second rapid cooling process S4, the treated subject M of which a difference in the temperature between the surface and the inside decreases through the first rapid cooling process S1, the gentle cooling process S2, and the holding process S3 is cooled to a temperature less than or equal to the transformation point Ms. For this reason, the structures of the surface and the inside of the treated subject M are almost simultaneously transformed into the martensitic structure. Furthermore, when the target temperature Ta is a temperature which is higher than the transformation point Ms by several tens of ° C., a difference in the temperature between the surface and the inside of the treated subject M generated by the cooling in the second rapid cooling process S4 may be minutely suppressed. Then, the treated subject M is prevented from being deformed or warpage, so that the quality of the treated subject M improves.

In the second rapid cooling process S4, the treated subject M is rapidly cooled to a temperature less than or equal to the transformation point Ms so as to avoid the transformation point Bs where the structure starts to be transformed into a bainitic structure by the mist cooling. In the present embodiment, even in the second rapid cooling process S4, the control unit 60 drives the first pump 33 through the first inverter 36 (the adjusting process). Then, the cooling is performed by supplying and spraying the mist-like cooling liquid from the first nozzle 35 in the first cooling system 30. That is, even in a cooling pattern in which not only the rapid cooling for the treated subject is needed when starting the cooling process, but also the rapid cooling for the treated subject M is needed during the cooling process, the above-described cooling pattern may be handled by performing multiple cooling using the first cooling system 30.

Furthermore, with regard to the cooling in the second rapid cooling process S4, when the temperature of the treated subject M is sufficiently far from the transformation point Bs and the treated subject M does not need to be rapidly cooled, for example, the treated subject M may be cooled by using the second cooling system 40 used in the gentle cooling process S2.

With the description above, the cooling process of the present embodiment which transforms the structure of the treated subject M into the martensitic structure ends.

Accordingly, according to the present embodiment, the following effects may be obtained.

According to the present embodiment, since the first nozzle 35 used for the rapid cooling and the second nozzle 45 used for the gentle cooling with the uniformity of cooling are provided, the heated treated subject M may be cooled at a wide range of cooling speeds. For this reason, the rapid cooling may be performed during a certain period, and the gentle cooling may be performed with the uniformity of cooling during the other period so as to prevent deformation or warpage of the treated subject.

While the preferred embodiment according to the invention has been described by referring to the accompanying drawings, the invention is not limited to these examples. All shapes, combinations, or the like of the respective components illustrated in the above-described example are examples, and may be modified into various forms based on the requirements in design and the like without departing from the spirit of the invention.

For example, in the above-described embodiment, the diffusion angle of the cooling mist in the first nozzle 35 is set to be narrower than the diffusion angle of the cooling mist in the second nozzle 45. However, the above-described embodiment is not limited thereto, and the diffusion angles may be equal to each other when a difference in the particle diameter of the cooling mists occurs.

Further, in the above-described embodiment, the spraying of the cooling mist is switched between the first nozzle 35 and the second nozzle 45, but the invention is not limited thereto. In the above-described embodiment, the first nozzle 35 and the second nozzle 45 simultaneously spray the cooling mists, and then the control unit 60 may control and adjust the respective ejection amounts.

Further, in the above-described embodiment, as the cooling system which sprays the mist-like cooling liquid into the container 10, the first cooling system 30 with the first nozzle 35 and the second cooling system 40 with the second nozzle 45 are provided, but the invention is not limited thereto. In the above-described embodiment, one cooling system may be equipped with both the first nozzle 35 and the second nozzle 45. Furthermore, in this case, one cooling system may be equipped with a predetermined ejection amount adjusting unit which adjusts the ejection amounts from the first nozzle 35 and the second nozzle 45.

Further, in the above-described embodiment, the holding process S3 in which the cooling mist is not sprayed is provided, but the invention is not limited thereto. In the above-described embodiment, after the gentle cooling process S2 is performed, the second rapid cooling process S4 may be performed without performing the holding process S3.

[Industrial Applicability]

According to the invention, the treated subject of the heat treatment may be cooled at a wide range of cooling speeds. Further, the rapid cooling is performed during a certain period, and the gentle cooling may be performed while the uniformity of cooling is maintained during the other period.

[Reference Signs List]

1: heat treatment apparatus
3: cooling chamber (mist cooling apparatus)
35: first nozzle
45: second nozzle
60: control unit
M: treated subject

What is claimed is:

1. A mist cooling apparatus that cools a heated treated subject by spraying a cooling mist thereto, the mist cooling apparatus comprising:

a container which is substantially cylindrical and contains the heated treated subject;

a first nozzle, which is provided in the container, that sprays a cooling mist;

a second nozzle, which is provided in the container, that sprays a cooling mist having a particle diameter smaller than the particle diameter of the cooling mist sprayed from the first nozzle; and a control unit that is configured to control the spraying of the cooling mist from at least one of the first nozzle and the second nozzle according to various cooling patterns for the treated subject from the start of the cooling until the end of the cooling, wherein the first nozzle and the second nozzle are plurally disposed in the axial direction of the container, and wherein the first nozzle and the second nozzle diffuse and spray the cooling mists, and wherein the diffusion angle of the cooling mist in the first nozzle is narrower than the diffusion angle of the cooling mist in the second nozzle.

2. The mist cooling apparatus according to claim 1, wherein the control unit allows the second nozzle to spray in one of the various cooling patterns that gently cools the treated subject while the uniformity of cooling is maintained.

3. The mist cooling apparatus according to claim 2, wherein the first nozzle is provided at left and right sides of the treated subject and upper and lower sides of the treated subject.

4. A mist cooling method of cooling a heated treated subject by spraying a cooling mist thereto, the mist cooling method comprising:

cooling the treated subject by using a first nozzle spraying a cooling mist and a second nozzle spraying a cooling mist having a particle diameter smaller than the particle diameter of the cooling mist sprayed from the first nozzle, wherein the cooling mist is sprayed from at least one of the first nozzle and the second nozzle in accordance with various cooling patterns for the treated subject from the start of the cooling until the end of cooling, operating the first nozzle results in one cooling rate, and operating the second nozzle results in another cooling rate, and production of an internal structure of the treated subject is controlled by the temperature of the treated subject being controlled using a latent heat of vaporization of the cooling mist by controlling spraying of the cooling mist from the first nozzle and the second nozzle, and wherein the first nozzle and the second nozzle diffuse and spray the cooling mists, and wherein the diffusion angle of the cooling mist in the first nozzle is narrower than the diffusion angle of the cooling mist in the second nozzle.

* * * * *